US010545425B2

(12) United States Patent
Makino

(10) Patent No.: US 10,545,425 B2
(45) Date of Patent: Jan. 28, 2020

(54) IMAGE FORMING APPARATUS

(71) Applicant: CANON KABUSHIKI KAISHA, Tokyo (JP)

(72) Inventor: Masahiro Makino, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/935,189

(22) Filed: Mar. 26, 2018

(65) Prior Publication Data

US 2018/0292767 A1 Oct. 11, 2018

(30) Foreign Application Priority Data

Apr. 10, 2017 (JP) ..... 2017-077781

(51) Int. Cl.
*G03G 15/00* (2006.01)
*G03G 15/02* (2006.01)
*G03G 15/01* (2006.01)

(52) U.S. Cl.
CPC ..... *G03G 15/0283* (2013.01); *G03G 15/0152* (2013.01); *G03G 15/0266* (2013.01); *G03G 15/5004* (2013.01); *G03G 15/5016* (2013.01)

(58) Field of Classification Search
CPC ..... G03G 15/0283; G03G 15/0152; G03G 15/0266; G03G 15/5004; G03G 15/5016; G03G 15/5062
See application file for complete search history.

(56) References Cited

U.S. PATENT DOCUMENTS

| | | | |
|---|---|---|---|
| 2007/0201893 | A1 | 8/2007 | Yamazaki |
| 2008/0031646 | A1 | 2/2008 | Ishibashi et al. |
| 2011/0292461 | A1 | 12/2011 | Kubo |
| 2013/0003090 | A1 | 1/2013 | Sato |
| 2013/0177328 | A1 | 7/2013 | Fukuda et al. |

FOREIGN PATENT DOCUMENTS

| | | | | |
|---|---|---|---|---|
| JP | 2009-237219 | A | | 10/2009 |
| JP | 2010-266786 | A | | 11/2010 |
| JP | 2010266786 | A | * | 11/2010 |
| JP | 2012-181467 | A | | 9/2012 |

OTHER PUBLICATIONS

Extended European Search Report dated Jul. 18, 2018, in European Patent Application No. 18163887.5.

* cited by examiner

*Primary Examiner* — David M. Gray
*Assistant Examiner* — Michael A Harrison
(74) *Attorney, Agent, or Firm* — Venable LLP

(57) ABSTRACT

An image forming apparatus includes a photosensitive member, a charging roller, an exposure device, a developing device, a transfer member, a fixing device, a voltage source for output the charging voltage, an executing portion for forming a test chart including a plurality of adjusting images in setting of peak-to-peak voltage values of AC voltages at a plurality of different values, a first inputting portion through which an instruction of execution of forming the test chart is inputted, and a second inputting portion through which an instruction of setting a value of peak-to-peak voltage values of the AC voltage during image formation is inputted.

17 Claims, 7 Drawing Sheets

IMAGE FORMING APPARATUS

FIELD OF THE INVENTION AND RELATED ART

The present invention relates to an image forming apparatus, such as a copying machine, a printer or a facsimile machine, of an electrophotographic type, or an electrostatic recording type.

Conventionally, in the image forming apparatus of the electrophotographic type or the like, as a type of electrically charging an image bearing member, a type in which an electroconductive charging member is contacted to or brought near to the image bearing member such as a photosensitive member and a charging voltage is applied to the charging member has been used. In the following, a contact charging type in which the charging member is contacted to the image bearing member will be described as an example.

As the charging member, a charging roller including an elastic layer formed with an electroconductive rubber has been widely used. Further, as a type of applying the charging voltage, a DC charging type in which only a DC voltage is applied to the charging member and an AC charging type in which an oscillating voltage in the form of a DC voltage biased with an alternating voltage (AC voltage) is applied to the charging member are used. The AC charging type has an advantage such that the image bearing member is uniformly electrically charged easily by a potential smoothing effect through AC discharge.

A proper charging voltage changes depending on characteristics and use hysteresis of the image bearing member and the charging member. For that reason, the charging voltage is determined in many cases depending on an environment or the use hysteresis of the image bearing member and the charging member by, for example, charging voltage control periodically carried out. Particularly, as a control method of a peak-to-peak voltage value of the AC voltage (herein, this value is referred simply to as an "AC voltage value"), a method in which an alternating current (AC) value is detected by changing the AC voltage value, and on the basis of a detection result thereof, setting of an AC value capable of providing a desired discharge current value is determined.

Further, due to manufacturing variations, among individual units and per every manufacturing lot, differences in electric resistance and hardness of the charging member with respect to a longitudinal direction may occur in some cases. Further, due to abrasion of the charging member and deposition of contaminants (toner, paper powder and the like) on the charging member by an increase in use amount of the charging member, a difference may occur in a surface state of the charging member with respect to the longitudinal direction in some cases. In the charging voltage control as described above, the charging voltage is determined on the basis of, e.g., a current flowing through an entirety of the charging member, and therefore, when only this control is carried out, improper charging may occur at any portion of the charging member with respect to the longitudinal direction in some cases.

Japanese Laid-Open Patent Application (JP-A) 2010-266786 proposes a method in which densities of a calibration pattern, at a plurality of longitudinal positions, formed using an AC voltage value of a charging voltage as initial setting are detected, and depending on a detection result thereof, the AC voltage value of the charging voltage is increased in a predetermined range.

Here, in the AC charging type, in general, there is tendency that a charging property of the image bearing member is more stable with an increasing AC voltage value and thus the image bearing member can be uniformly charged. However, when the AC voltage value is excessively large, a discharge amount between the charging member and the image bearing member becomes excessively large, so that problems of an image blur due to a discharge product, a lowering in lifetime of the image bearing member due to a deterioration of a surface layer of the image bearing member, and the like generate. On the other hand, when the AC voltage value is excessively small, minute stripe or dot image defects (white stripe, white dot, dark stripe, dark point) generate.

For that reason, there is a need to accurately acquire an AC voltage value capable of suppressing the image blur and the lowering in lifetime to a minimum without generating the minute stripe or dot image defects. However, in the case where a density sensor is used as disclosed in JP-A 2010-266786, there is no resolving power for detecting the minute stripe or dot image defects, so that the use of the density sensor cannot be said to be proper in the case where the AC voltage value is acquired with accuracy.

SUMMARY OF THE INVENTION

According to an aspect of the present invention, there is provided an image forming apparatus comprising a rotatable photosensitive member; a charging roller configured to electrically charge the photosensitive member by applying a charging voltage in a form of a DC voltage biased with an AC voltage; an exposure device configured to expose the photosensitive member charged by the charging roller to light to form an electrostatic latent image; a developing device configured to develop the electrostatic latent image into a toner image by depositing toner on the electrostatic latent image formed on the photosensitive member; a transfer member configured to transfer the toner image onto a recording material; a fixing device configured to fix the transferred toner image on the recording material; a voltage source configured to output the charging voltage applied to the charging roller; an executing portion configured to form a test chart including a plurality of adjusting images on the recording material, the plurality of adjusting images are formed by the photosensitive member charged by applying charging voltages in the form of a predetermined DC voltage biased with AC voltages of different peak-to-peak voltage values, respectively; a first inputting portion through which an instruction of execution of forming the test chart is inputted; and a second inputting portion through which an instruction of setting a value of the peak-to-peak voltage values of AC voltage during image formation is inputted.

According to another aspect of the present invention, there is provided an image forming apparatus comprising: an image forming portion including a plurality of toner image forming portions in which toner of a plurality of colors are used; an outputting portion configured to execute an output process for outputting a photosensitive member on which an image is formed by the image forming portion; an executing portion configured to execute an output process of a test chart including a plurality of adjusting images by controlling the outputting portion; and an inputting portion through which an instruction of execution of the output process of the test chart including only a toner image, of toner images corresponding to the plurality of colors, corresponding to a predetermined color is inputted.

According to a further aspect of the present invention, there is provided an image forming apparatus comprising: a rotatable photosensitive member; a charging roller configured to electrically charge the photosensitive member; an exposure device configured to expose the photosensitive member charged by said charging roller to light on the basis of an image signal thereby to form an electrostatic latent image; a developing device configured to form a toner image by depositing toner on the electrostatic latent image formed on the photosensitive member; a transfer member configured to transfer the toner image onto a recording material; a fixing device configured to fix the transferred toner image on the recording material; an outputting portion configured to execute an output process of the recording material on which the toner image is fixed; an executing portion configured to execute an output process of a test chart including a plurality of adjusting images by controlling said outputting portion, wherein the executing portion sets the image signal at a level of a halftone image signal common to the plurality of adjusting images; and an inputting portion through which an instruction of execution of the output process of the test chart is inputted.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Constitution and Operation of Image Forming Apparatus

Figure 1:
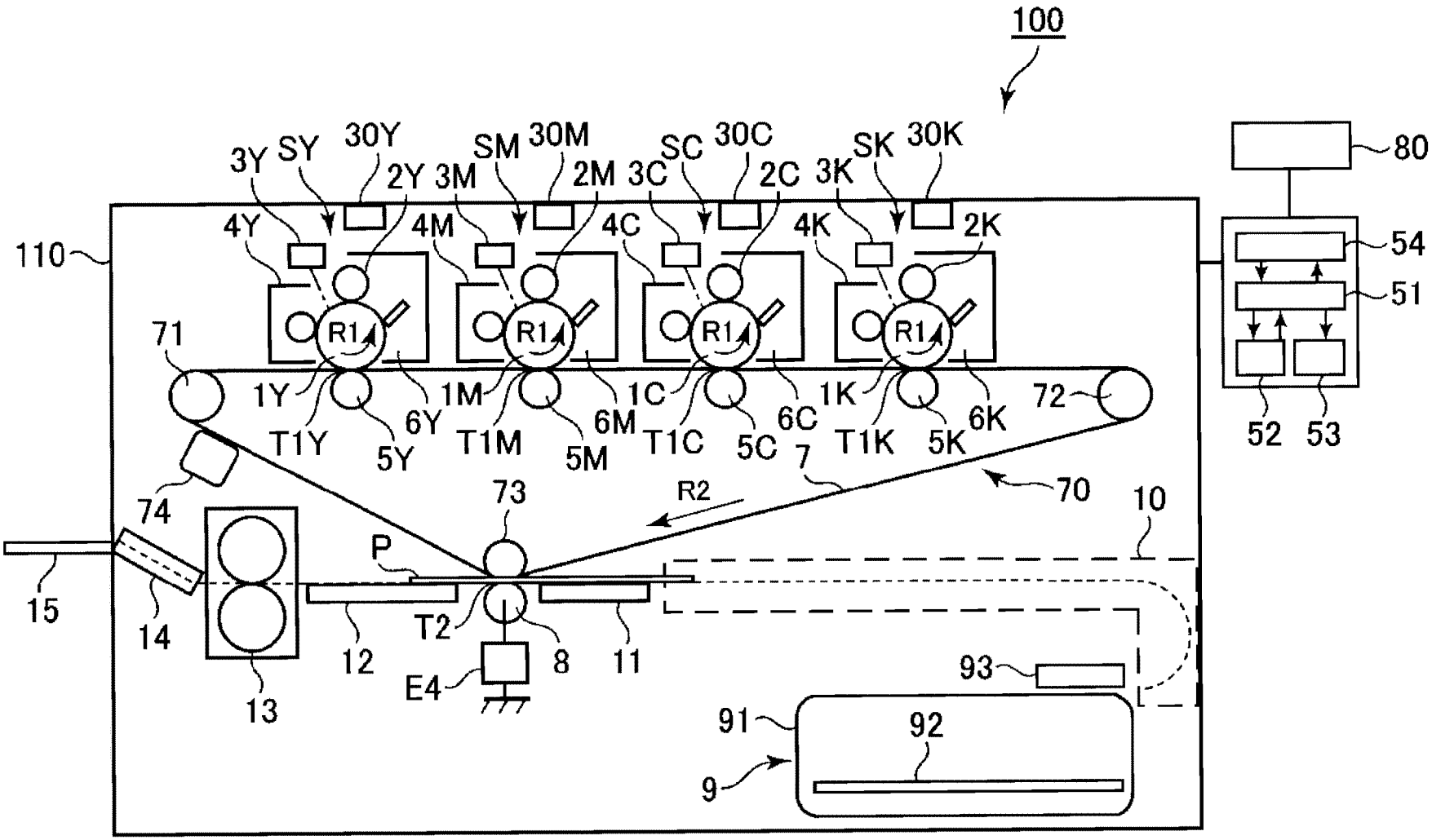
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type printer employing an intermediary transfer type capable of forming a full-color image by using an electrophotographic type.

Figure 2:
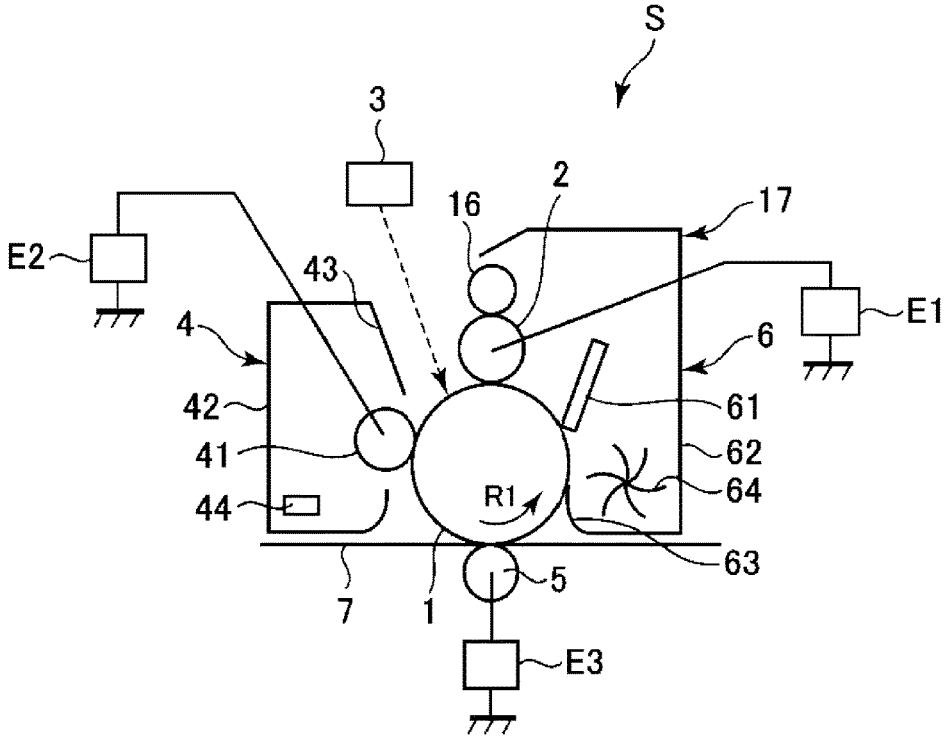
FIG. 2 is a schematic sectional view showing an image forming portion.

The image forming apparatus 100 includes, as a plurality of image forming portions, first to fourth image forming portions SY, SM, SC and SK for forming images of yellow (Y), magenta (M), cyan (C) and black (K), respectively. Incidentally, elements having the same or corresponding functions and constitutions in the respective image forming portions SY, SM, SC and SK are collectively described by omitting suffixes Y, M, C and K for representing elements for associated colors in some cases. FIG. 2 is a schematic sectional view showing a single image forming portion S as a representative. In this embodiment, the image forming portion S is constituted by including a photosensitive drum 1, a charging roller 2, an exposure device 3, a developing device 4, a primary transfer roller 5, a drum cleaning device 6, and the like, which are described later.

The image forming apparatus 100 includes the photosensitive drum 1 which is a rotatable drum-shaped (cylindrical) photosensitive member (electrophotographic photosensitive member) as an image bearing member for bearing a toner image.

The photosensitive drum 1 is rotationally driven in an indicated arrow R1 direction (counterclockwise direction) at a predetermined peripheral speed (process speed) by a driving motor (not shown) as a driving means. A surface of the rotating photosensitive drum 1 is electrically charged uniformly to a predetermined polarity (negative in this embodiment) and a predetermined potential by the charging roller 2 which is a roller-type charging member as a charging means. During a charging step, to the charging roller 2, from a charging voltage source (high-voltage source circuit) E1 as an applying means, as a charging voltage (charging bias), an oscillating voltage in the form of a DC voltage (DC component) biased with an AC voltage (AC component) is applied. In this embodiment, the charging roller 2 electrically charges the photosensitive drum 1 by electric discharge generating in at least one of minute gaps between the charging roller 2 and the photosensitive drum 1 on upstream and downstream sides of a contact portion between the charging roller 2 and the photosensitive drum 1 with respect to a rotational direction of the photosensitive drum 1. The surface of the photosensitive drum 1 is charged to a potential which is substantially the same as a DC voltage value of the charging voltage. A charging roller cleaning member 16 for cleaning the charging roller 2 is provided in contact with the charging roller 2. The charged surface of the charged photosensitive drum 1 is exposed to a laser beam modulated depending on image information by the exposure device (laser scanner) 3 as an exposure means (electrostatic image forming means), so that an electrostatic image (electrostatic latent image) is formed on the photosensitive drum 1.

The electrostatic image formed on the photosensitive drum 1 is developed (visualized) with the developer by the developing device 4, so that the toner image is formed on the photosensitive drum 1. In this embodiment, toner charged to the same polarity as a charge polarity (negative polarity in this embodiment) of the photosensitive drum 1 is deposited on an exposed portion, on the photosensitive drum 1, where an absolute value of a potential is lowered by subjecting the surface of the photosensitive drum 1 to the exposure to the laser beam after uniformly charging the surface of the photosensitive drum 1. That is, in this embodiment, a normal toner charge polarity which is the toner charge polarity during development is the negative polarity. The developing device 4 includes a developing container 42 accommodating a two-component developer containing toner (non-magnetic toner particles) as the developer and a carrier (magnetic carrier particles). Further, the developing device 4 includes a developing sleeve 41, as a developer carrying member rotatably provided in a developing container 42, which is 20 mm in outer diameter. Further, the developing device 4 includes a regulating blade 43 for regulating an amount of the developer on the developing sleeve 41, a developer container temperature sensor 44 for detecting a temperature of the developer in the developing container 42, a stirring screw (not shown) for supplying the developer to the developing sleeve 41, and the like. The developing sleeve 41 carries and feeds the developer to an opposing portion to the photosensitive drum 1 by the action of a magnetic field generated by a magnet roller (not shown) provided as a magnetic field generating means in a hollow portion of the developing sleeve 41, and thus supplies the toner to the photosensitive drum 1 depending on the electrostatic image on the photosensitive drum 1. During the development, to the developing sleeve 41, from a developing voltage source (high-voltage source circuit) E2, as a developing voltage (developing bias), an oscillating voltage in the form of a DC voltage (DC component) biased with an AC voltage (AC component) is applied. A DC voltage value of the developing voltage is set at a potential between a dark-portion potential formed on the photosensitive drum 1 charged by the charging roller 2 and a light-portion potential formed on the photosensitive drum 1 exposed to the laser beam at the dark-portion potential portion by the exposure device 3.

An intermediary transfer belt 7 constituted by an endless belt as an intermediary transfer member is provided so as to oppose the respective photosensitive drums 1. The intermediary transfer belt 7 is extended around a driving roller 71, a tension roller 72 and a secondary transfer opposite roller 73 which are used as stretching rollers, and is stretched with a predetermined tension. The intermediary transfer belt 7 is rotated (circulated) by rotationally driving the driving roller 71 in an indicated arrow R2 direction at a peripheral speed (process speed) substantially equal to the peripheral speed of the photosensitive drum 1. In an inner peripheral surface side of the intermediary transfer belt 7, a primary transfer roller 5 which is a roller-type primary transfer member as a primary transfer means is provided corresponding to the associated photosensitive drum 1. The primary transfer roller 5 is pressed (urged) against the intermediary transfer belt 7 toward the photosensitive drum 1, so that a primary transfer portion (primary transfer nip) T1 is formed where the photosensitive drum 1 and the intermediary transfer belt 7 contact each other.

The toner image formed on the photosensitive drum 1 is primary-transferred by the action of the primary transfer roller 5 onto the intermediary transfer belt 7 at the primary transfer portion T1. During a primary transfer step, to the primary transfer roller 5, a primary transfer voltage (primary transfer bias) which is a DC voltage of an opposite polarity to the normal charge polarity of the toner is applied from a primary transfer voltage source (high-voltage source circuit) E3. For example, during full-color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller (transfer member) 8 which is a roller-type secondary transfer member as a secondary transfer means is provided. The secondary transfer roller 8 is pressed (urged) against the intermediary transfer belt 7 toward the secondary transfer opposite roller 73 and forms a secondary transfer portion (secondary transfer nip) T2 where the intermediary transfer belt 7 and the secondary transfer roller 8 are in contact with each other. The toner images formed on the intermediary transfer belt 7 as described above are secondary-transferred by the action of the secondary transfer roller 8 onto a transfer(-receiving) material (sheet, recording material) P, such as a recording sheet, nipped and fed at the secondary transfer portion T2 by the intermediary transfer belt 7 and the secondary transfer roller 8. During a secondary transfer step, to the secondary transfer roller 8, a secondary transfer bias (secondary transfer voltage) which is a DC voltage of an opposite polarity to the normal charge polarity of the toner is applied from a secondary transfer voltage source (high-voltage source circuit) E4. In this embodiment, a transfer device 70 as a transfer means for transferring the toner images from the respective photosensitive drums 1 onto the transfer material P is constituted by the intermediary transfer belt 7, the stretching rollers 71-73 for stretching the intermediary transfer belt 7, the respective primary transfer rollers 5, the secondary transfer roller 8, and the like.

The transfer material P is accommodated in a cassette 91 of a feeding unit 9 in a state in which the transfer material P is held at a predetermined feeding position by a lifter plate 92. The transfer material P is fed one by one from the cassette 91 by a separation feeding member 92 of the feeding unit 9 and then is conveyed by a feeding and conveying unit 10. Then, the transfer material P is subjected to correction of oblique movement by a registration unit 11, and thereafter, the transfer material P is timed to the toner images on the intermediary transfer belt 7 and then is supplied to the secondary transfer portion T2.

The transfer material P on which the toner images are transferred is fed to a fixing device 13 by a pre-fixing feeding unit 12 and is heated and pressed by the fixing device 13, so that the toner images are fixed (melt-fixed) on the transfer material P. Thereafter, the transfer material P on which the toner images are fixed is discharged (outputted) by a discharging unit 14 to a discharge tray 15 provided outside the apparatus main assembly 110 of the image forming apparatus 100.

On the other hand, toner (primary transfer residual toner) and an external additive which remain on the photosensitive drum 1 during the primary transfer are removed and collected from the surface of the photosensitive drum 1 by a drum cleaning device 6 as a photosensitive member cleaning means. The drum cleaning device 6 includes a cleaning blade 61 as a cleaning member and includes a cleaning container 62. The drum cleaning device 6 scrapes the primary transfer residual toner off the surface of the rotating photosensitive drum 1 by the cleaning blade 61 provided in contact with the photosensitive drum 1 and accommodates the primary transfer residual toner in the cleaning container 62. In the drum cleaning device 6, a receptor sheet 63 formed of a 0.1 mm-thick urethane sheet is provided so that the toner scraped off the surface of the photosensitive drum 1 by the cleaning blade 61 does not fall on the intermediary transfer belt 7. Further, in the drum cleaning device 6, a feeding screw 64 for feeding the toner, accommodated in the cleaning container 62, for being collected in a collecting toner box (not shown) is provided.

Further, on an outer peripheral surface side of the intermediary transfer belt 7, a belt cleaning device 74 as an intermediary transfer member cleaning means is provided downstream of the secondary transfer portion T2 and upstream of the most-upstream primary transfer portion T1 with respect to a movement direction of the intermediary transfer belt 7.

Toner (secondary transfer residual toner) and an external additive which remain on the surface of the intermediary transfer belt 7 during a secondary transfer step are removed and collected from the surface of the intermediary transfer belt 7 by the belt cleaning device 74.

In this embodiment, the charging voltage source E1, the developing voltage source E2 and the primary transfer voltage source E3 are provided independently of each of the image forming portions S.

The image forming apparatus 100 in this embodiment is capable of changing the rotational speed of the intermediary transfer belt 7 to three kinds of speeds of 350 mm/sec, 290 mm/sec and 175 mm/sec depending on a kind and a thickness of the transfer material P.

In this embodiment, at each of the image forming portions S, the photosensitive drum 1, the charging roller 2, the charging roller cleaning member 16 and the drum cleaning device 6 integrally constitute a drum unit (drum cartridge) 17 detachably mountable to the apparatus main assembly 110 of the image forming apparatus 100. The drum unit 17 is exchanged with a new one in the case where for example, the photosensitive drum 1 reaches an end of its lifetime set in advance or in the like case. Further, in this embodiment, the developing device 4 is constituted as a developing unit (developing cartridge) detachably mountable to the apparatus main assembly 110 of the image forming apparatus 100, and is demounted from the apparatus main assembly 110, for exchanging the carrier, for example.

The image forming apparatus 100 performs a job (print operation) which is a series of operations which are started by a start instruction and in which an image is formed on a single transfer material P or on a plurality of transfer materials P and then the transfer materials P are outputted. The job generally includes an image forming step, a pre-rotation step, a sheet interval step in the case where the image is formed on the plurality of the transfer materials P, and a post-rotation step. The image forming step is a period in which formation of the electrostatic image for an image formed and outputted on the transfer material P, formation of the toner image, and primary transfer and secondary transfer of the toner image are actually performed, and "during image formation" refers to this period. Specifically, at each of positions where steps of effecting the formation of the electrostatic image, the formation of the toner image, and the primary transfer and the secondary transfer of the toner image, timing during image formation is different. The pre-rotation step is a period in which a preparatory operation, from input of the start instruction until the image formation is actually started, before the image forming step is performed. The sheet interval step is a period corresponding to an interval between a transfer material P and a subsequent transfer material P when the image formation is continuously performed (continuous image formation) with respect to the plurality of transfer materials P. The post-rotation step is a period in which a post-operation (preparatory operation) after the image forming step is performed. "During non-image formation" refers to a period other than "during image formation", and includes the pre-rotation step, the sheet interval step, the post-rotation step and further includes a pre-multi-rotation step which is a preparatory operation during main switch actuation of the image forming apparatus 100 or during restoration from a sleep state. In this embodiment, discharge current control and adjusting control of charging current setting which are described later are executed at predetermined timing during non-image formation.

In this embodiment, operations of the respective portions of the image forming apparatus 100 are subjected to integrated control by a controller (portion) 51 (outputting portion) as a control means provided in the apparatus main assembly 110 of the image forming apparatus 100. To the controller 51, a RAM 52, a ROM 53 and a back-up RAM 54 which are storing means are connected. The RAM 52 is used as a memory for an operation of the controller 51. In the ROM 53, programs executed by the controller 51 and various data are stored. The back-up RAM 54 is used for backing up data acquired by the controller 51. The controller 51 transfers signals between itself and the respective portions of the image forming apparatus 100 and controls operations of the respective portions of the image forming apparatus 100. In a relation with this embodiment, particularly, the controller 51 executes the discharge current control and the adjusting control of the charging voltage setting, which are described later.

Further, in the apparatus main assembly 110 of the image forming apparatus 100, an operating portion (input portion, operating panel) 80 is provided. The operating portion 80 includes keys and switches as inputting means for permitting an operator such as a user or a service person to input instructions to the controller 51 and includes a display or the like as a display means for displaying information for the operator. In this embodiment, the display of the operating portion 80 is constituted by a touch panel and also functions as an inputting means for inputting the instructions to the controller 51.

The image forming apparatus 100 includes an environment sensor 30, capable of detecting a temperature of an inside of the apparatus main assembly 110, as an environment detecting means for detecting at least one of a temperature and a humidity of at least one of an inside and an outside of the apparatus main assembly 110. In this embodiment, in order to accurately detect an ambient condition of each of the drum units 17, the environment sensor 30 is provided in the neighborhood of a portion above each of the drum units 17. A signal showing a detection result of the environment sensor 30 is inputted to the controller 50.

2. Photosensitive Drum

Figure 3:
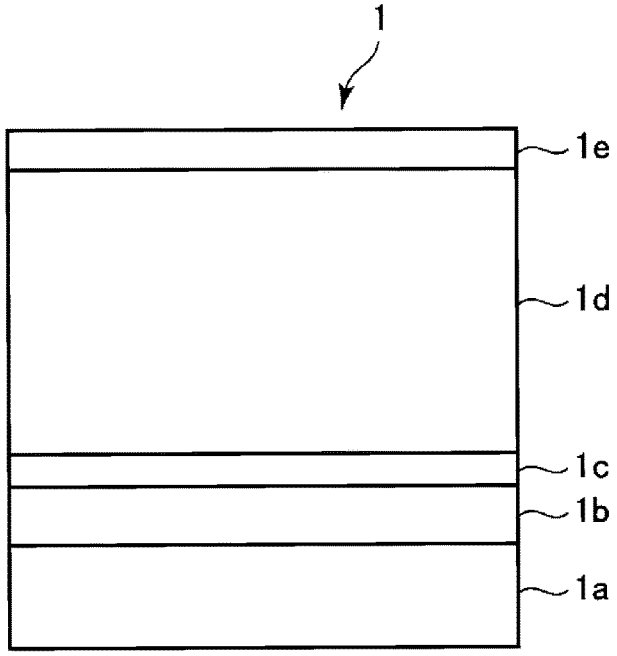
FIG. 3 is a schematic sectional view showing a structure of a photosensitive layer of a photosensitive drum.

FIG. 3 is a schematic sectional view for illustrating a photosensitive layer structure of the photosensitive drum 1. The photosensitive drum 1 includes a lamination-type OPC photosensitive layer in which an electroconductive substrate 1*a* which is a supporting member having electroconductivity, a charge-generating layer 1*c* containing a charge-generating substance and a charge-transporting layer 1*d* containing a charge-transporting substance are successively laminated in a named order. Further, between the surface of the electroconductive substrate 1*a* and the charge-generating layer 1*c*, an undercoat layer 1*b* having a barrier function and an adhesive function is provided. The undercoat layer 1*b* is provided for the purposes of improvement of an adhesive property of the photosensitive layer, improvement of a coating property, protection of the supporting member, coating of a hole or the like on the electroconductive substrate 1*a*, improvement of a charge injection property from the supporting member, protection of the photosensitive layer against electrical breakdown, and the like. Further, a surface protection layer 1*e* is provided on the photosensitive layer of a function separation type in which the charge-generating layer 1*c* and the charge-transporting layer 1*d* are successively laminated.

In this embodiment, an outer diameter of the photosensitive drum 1 is 30 mm. Further, in this embodiment, the surface of the photosensitive drum 1 is abraded by an abrading tape (lapping paper), buffing or the like, so that a ten-point average roughness Rz (JIS B0601-1982) is 0.2-2 μm.

3. Charging Roller

Figure 4:
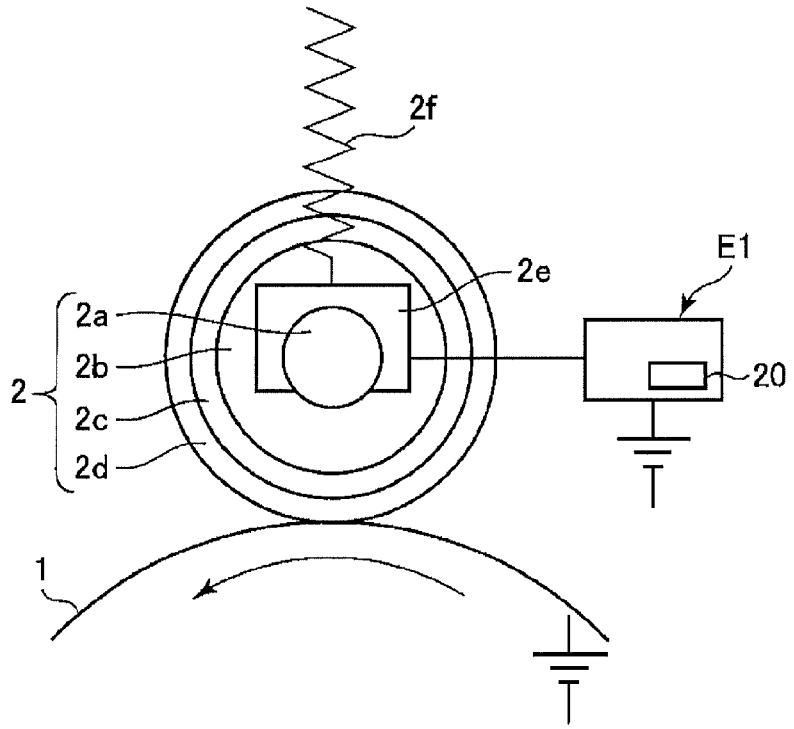
FIG. 4 is a schematic sectional view of a charging roller and a neighborhood thereof.

FIG. 4 is a schematic sectional view of the charging roller 2 and the neighborhood thereof.

The charging roller 2 is rotatably supported by bearing members 2*e* at end portions of core metal (supporting members) 2*a* with respect to a longitudinal direction (rotational axis direction). Further, the charging roller 2 is urged toward the photosensitive drum 1 by urging of the bearing members 2*e* by urging springs 2*f*, respectively. The charging roller 2 is rotated with rotation of the photosensitive drum 1.

In this embodiment, a length of the charging roller 2 with respect to the longitudinal direction (rotational axis direction) is 330 mm, and an outer diameter of the charging roller 2 is 14 mm.

The charging roller 2 includes, on an outer peripheral surface of the core metal 2*a*, an elastic layer having a three layer structure consisting of a lower layer 2*b*, an intermediary layer 2*c*, and a surface layer 2*d*, which are successively laminated in the named order. The core metal 2*a* is a stainless steel rod with an outer diameter of 6 mm. The lower layer 2*b* is an electron-conductive layer formed of carbon-dispersed foam EPOM (ethylene-propylene-diene rubber) (specific gravity: 0.5 g/cm3, volume resistivity $10^7$-$10^9$ ohm·cm, layer thickness: about 3.5 mm). The intermediary layer 2*c* is formed of carbon dispersed NBR (nitrile-butadiene rubber) rubber (volume resistivity: $10^2$-$10^5$ ohm·cm, layer thickness: about 500 μm). The surface layer 2*d* is an ion-conductive layer of fluorinated alcohol-soluble nylon resin in which tin oxide and carbon particles are dispersed (volume resistivity: $10^7$-$10^{10}$ ohm·cm, surface roughness (JIS ten-point average surface roughness Rz): 1.5 μm, layer thickness: about 5 μm).

To the charging roller 2, a charging voltage source E1 capable of outputting an oscillating voltage in the form of a DC voltage biased with an AC voltage is connected. In this embodiment, the charging voltage source E1 is capable of outputting the DC voltage of 0 to −1000 V and the AC voltage of 0 to 2800 Vpp (peak-to-peak voltage). In this embodiment, a frequency of the AC voltage of a charging voltage is about 1.5 to 2.0 kHz. In the charging voltage source E1, a current detecting circuit 20 as a current detecting means is incorporated. The current detecting circuit 20 is capable of detecting a value of an alternating current flowing through the current detecting circuit 20 (charging voltage source E1) when the charging voltage source E1 applies the voltage to the charging roller 2, i.e., a value of the alternating current flowing between the charging roller 2 and the photosensitive drum 1. A signal showing a detection result of the current detecting circuit 20 is inputted to the controller 51.

4. Discharge Current Control

The discharge current control in this embodiment will be described.

In this embodiment, the image forming apparatus 100 executes the discharge current control for determining setting of a reference of the AC voltage value of the charging voltage. In the discharge current control, the setting of the AC voltage value of the charging voltage is changed to a plurality of settings and a value of the alternating current flowing through the charging voltage source E1 when the photosensitive drum 1 is charged under each of the settings is detected by the current detecting circuit 20. Then, on the basis of a detection result, the setting of the AC voltage value of the charging voltage capable of bringing the discharge current value, when the photosensitive drum 1 is charged, near to a predetermined discharge current value is determined.

Figure 5:
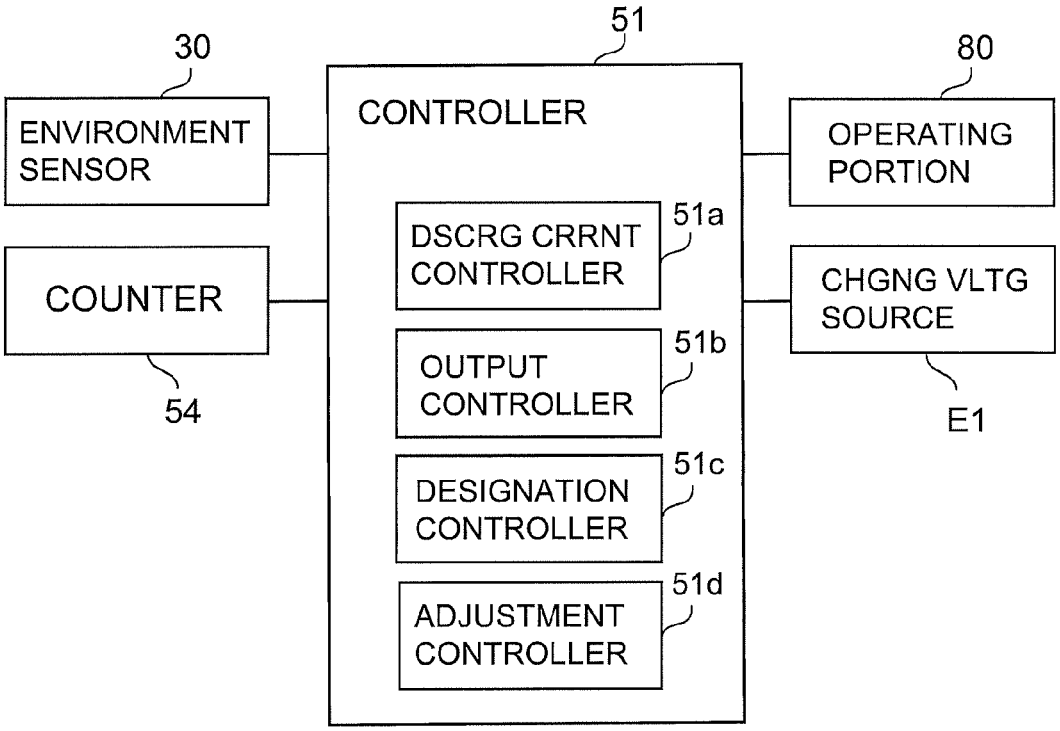
FIG. 5 is a functional block diagram showing a principal part of the image forming apparatus.

FIG. 5 is a function block diagram of a principal part of the image forming apparatus 100 in this embodiment. In this embodiment, the controller 51 has a function as a discharge current controller 51*a* for controlling the respective portions of the image forming apparatus 100 in accordance with a discharge current control program stored in the ROM 53. In this embodiment, the controller 51 as the discharge current controller executes the discharge current control in the case where a main switch (power source) is turned from OFF to ON or in the case where a cumulative print number reaches a predetermined print number, or in the like case.

Incidentally, the print number is integrated every output of an image on a single sheet and is stored in the back-up RAM 54 functioning as a counter (counting means). Further, the discharge current control is carried out in, as during non-image formation, the pre-multi-rotation step after the main switch is turned OFF to ON, or in the pre-rotation step, the sheet interval step, the post-rotation step or the like after the integrated print number reaches the predetermined print number. However, timing of execution of the discharge current control may be any timing when a state of the photosensitive drum 1 and the charging roller 2 (the drum unit 17 in this embodiment) changes and a discharge amount under application of the charging voltage can change. Further, as described later, in this embodiment, the discharge current control is carried out also before an adjusting image is formed in the adjusting control of the charging voltage setting.

Figure 6:
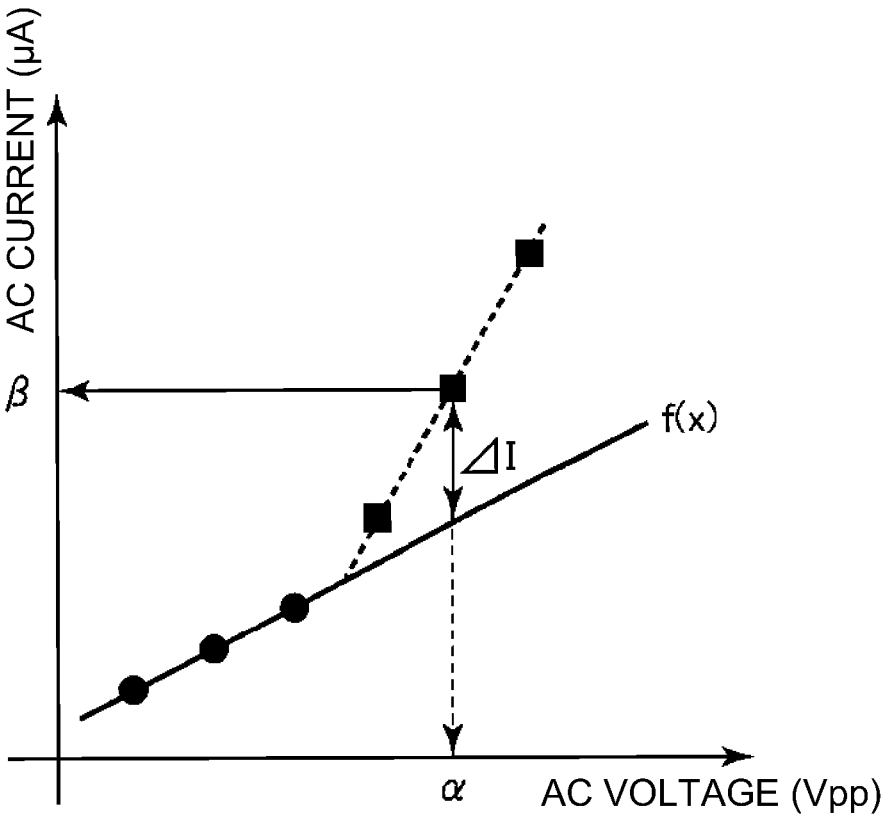
FIG. 6 is a graph for illustrating discharge current control.

Description will be further made with reference to FIG. 6. When the AC voltage is applied to between the charging roller 2 and the photosensitive drum 1, in an undischarged region based on Paschen's law, the value of the alternating current flowing between the charging roller 2 and the photosensitive drum 1 exhibits linearity. Therefore, first, the controller 51 applies, to the charging roller 2, at least one AC voltage in the undischarged region and causes the current detecting circuit 20 to detect the alternating current value. The controller 51 subjects a relationship between the AC voltage value and the alternating current value based on detection results to linear approximation by the least-square method (f(x) in FIG. 6). Then, the controller 51 changes at least one AC voltage value in the undesignated region, for example, every predetermined interval, and the resultant AC voltages are successively applied to the charging roller 2, and causes the current detecting circuit 20 to detect the alternating current values. Then, the controller 51 calculates a difference ΔI between the alternating current value detected with respect to the AC voltage value in the discharged region and the alternating current value corresponding to the same AC voltage value in a relationship in which the above-described f(x) is subjected to forward correction to the discharged region. This ΔI is defined as a "discharge current amount". Then, the controller 51 acquires an AC voltage value and an alternating current value, which are capable of bringing the calculated ΔI near to a desired discharge current value depending on a present status. For example, in FIG. 6, in the case where ΔI at an AC voltage value α (Vpp) is substantially equal to the desired discharge current value, an alternating current value β (μA) at that time is a control target value of the alternating current value (i.e., setting of the AC voltage value of the charging voltage). Incidentally, in the case where ΔI approximates the desired discharge current value within a predetermined range, discrimination that the predetermined discharge current value was acquired may be made (the same applies hereinafter). Then, the AC voltage of the charging voltage is controlled (constant-charging voltage control), so that the desired discharge current value can be acquired.

In this embodiment, depending on a temperature detected by the environment sensor 30, the above-described desired discharge current amount is changed. In this embodiment, this desired discharge current amount is set at about 70 μA in a low-temperature environment (less than 20° C.), about 60 μA in a normal-temperature environment (20° C. or more and less than 30° C.), and about 50 μA in a high-temperature environment (30° C. or more). That is, the desired discharge current amount in the case where the temperature is a second temperature higher than a first temperature is smaller than the desired discharge current amount in the case where the temperature is the first temperature. In this embodiment, a value of the desired discharge current amount is set at a large value so that improper charging does not generate even if the adjusting control of the charging voltage setting described later is not carried out. Information (control table) showing a relationship between the temperature and the desired discharge current amount is stored in the ROM 53 in advance.

The controller 51 causes the back-up RAM 54 to store a result of the discharge current control (i.e., a control target value of the alternating current value in this embodiment) as setting of a reference of the AC voltage value of the charging voltage. Further, the controller 51 uses the setting, when the photosensitive drum 1 is charged, until the setting is renewed by subsequent discharge current control.

Incidentally, as a method in which the setting of the AC voltage value of the charging voltage providing the desired discharge current value is determined from the relationship between the AC voltage value and the alternating current value as shown in FIG. 6, an arbitrary method can be employed. For example, while successively changing the AC voltage value in the discharged region, it is possible to seek the AC voltage value at which ΔI is substantially equal to the desired discharge current amount. Further, alternating current values at at least two AC voltage values in the discharged region are detected, and a relationship between the AC voltage values and the alternating current values is acquired (by linear approximation by the least-square method, for example). Then, an AC voltage value at which a difference (corresponding to the above-described ΔI) between the relationship (the above-described f(x)) in the undischarged region and the relationship in the discharged region is substantially equal to the desired discharge current amount can be acquired by calculation (computation).

In the discharge current control, detection of the alternating current value in each of settings by changing the setting of the AC voltage value of the charging voltage to a plurality of settings is not limited to the above-described detection such that the AC voltage value to be outputted is changed to the plurality of values as described above and then the values of the alternating currents flowing at those times are detected. The detection also includes the case where the AC voltage value is changed so that a plurality of detected alternating current values are acquired and then output values of the AC voltage values at those times are detected (recorded).

Further, the setting of the AC voltage value of the charging voltage is not limited to setting of the control target value of the alternating current value as described above, but may also be the control target value of the AC voltage value. For example, in FIG. 6, in the case where ΔI at the AC voltage value α (Vpp) is substantially equal to the desired discharge current amount, the AC voltage value α (Vpp) at that time can be used as the control target value (setting of the AC voltage value of the charging voltage) of the AC voltage value. By controlling the AC voltage of the charging voltage (constant-voltage control) so as to maintain the AC voltage value α (Vpp) which is the control target value, a desired discharge current value can be obtained.

5. Adjusting Control of Charging Voltage Setting

Next, adjusting control of the charging voltage setting in this embodiment will be described.

In this embodiment, the image forming apparatus 100 uses, as reference setting, setting of the AC voltage value of the charging voltage determined in the above-described discharge current control, and carries out the adjusting control of the charging voltage setting in which an adjusting amount (offset amount) is acquired from the region setting. As a result, depending on a characteristic (difference among individuals, lot difference or the like) and a state (use hysteresis or the like) of the photosensitive drum 1 and the charging roller 2 (drum unit 17 in this embodiment), a proper charging voltage such that a discharge amount is a necessary minimum value can be set with accuracy.

In the adjusting control, an output process for transferring and outputting a plurality of adjusting images onto the transfer material P is executed. Further, in the adjusting control, a designating process for designating at least one of the outputted adjusting images is executed. Further, in the adjusting control, an adjusting process for adjusting setting of the AC voltage value of the charging voltage on the basis of a designation result in the designating process (i.e., for determining the adjusting amount (offset amount) from the region setting is executed.

As shown in FIG. 5, in this embodiment, the controller 51 has a function as an output controller 51*b* for controlling the respective portions of the image forming apparatus 100 in accordance with an output process program stored in the ROM 53. The controller 51 as an output controller (executing portion) executes the output process for transferring and outputting, onto the transfer material P, the adjusting images formed with toner by using setting of a plurality of different AC voltage values of the charging voltage. Specifically, as described later, a process of outputting a chart on which a plurality of adjusting images formed using the setting of the plurality of different AC voltage values of the charging voltage is carried out. Further, in this embodiment, the controller 51 has a function as a designation controller 51*c* for controlling the respective portions of the image forming apparatus 100 in accordance with the designating process stored in the ROM 53. The controller 51 as a designating controller executes the designating control for designating at least one of the outputted adjusting images. Specifically, as described later, a process in which an interface for permitting input of information designating at least one of the adjusting images transferred on the chart is displayed on a display of an operating portion 80 (input portion) and the information inputted through this interface by an operator is received is executed. Further, in this embodiment, the controller 51 has a function as an adjusting controller 51*d* for controlling the respective portions of the image forming apparatus 100 in accordance with an adjusting process program stored in the ROM 53. The controller 51 as an adjusting controller (voltage setting portion) adjusts setting of the AC voltage value of the charging voltage during image formation on the basis of setting of the AC voltage value of the charging voltage when the adjusting image designated in the designating process is formed (i.e., determines the adjusting amount (offset amount) from the reference setting). In the following, description will be made further specifically.

Figure 7:
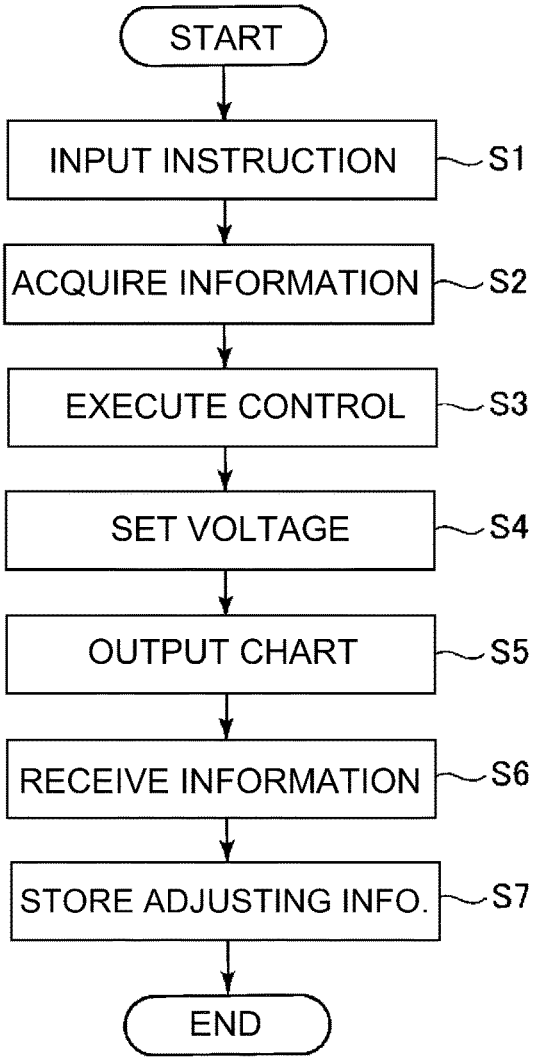
FIG. 7 is a flowchart of adjusting control of charging voltage setting.

FIG. 7 is a flowchart showing a schematic procedure of the adjusting control (adjusting mode) in this embodiment. This adjusting control may desirably be carried out in the case where the drum unit 17 is exchanged (i.e., before a first image is formed after a new drum unit 17 is mounted in the apparatus main assembly 110) or when some image defect due to charging generates.

Figure 8:
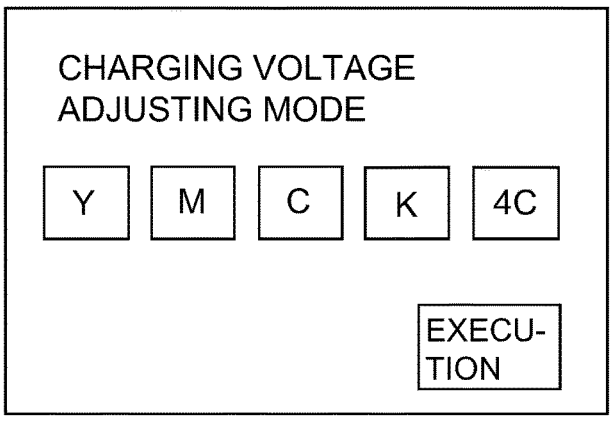
FIG. 8 is a schematic view of an interface for executing the adjusting control of the charging voltage setting.

First, the controller 51 starts the adjusting control when an instruction of a start of the adjusting control is provided from the operating portion 80 (S1). For example, the operator can provide the instruction to start the adjusting control by selecting a color, to be adjusted, through an interface displayed on the display of the operating portion 80 as shown in FIG. 8. In this embodiment, the adjusting control of any one or a plurality of colors (Y, M, C or K in FIG. 8) or all colors (4C in FIG. 8) can be carried out. The start of the adjusting control is not limited to the instruction through the operating portion 80, but may also be capable of being instructed from a printer driver installed in an external device such as a PC (personal computer) communicatably connected with the image forming apparatus 100.

Then, the controller 51 acquires environment information detected by the environment sensor 30 of the image forming portion S to be adjusted (S2). The charging roller 2 and the photosensitive drum 1 change in electric resistance, dielectric constant and the like depending on a temperature, a humidity or the like. For that reason, in order to adjust the setting of the charging voltage with accuracy, it is desired that information on an environment in which the drum unit 17 is disposed is acquired. In this embodiment, the controller 51 acquires temperature information detected by the environment sensor 30 provided in the neighborhood of the portion above each of the drum units 17 as described above.

Next, the controller 51 executes the above-described discharge current control (S3). At this time, the controller 51 acquires setting (control target value of the alternating current value in this embodiment) of the AC voltage value of the charging voltage capable of providing the photosensitive drum discharge current value depending on the temperature information acquired in S2, and causes the back-up RAM 54 to store a result thereof as the reference setting.

Next, the controller 51 acquires setting of the AC voltage value of the charging voltage when the adjusting image is formed (S4). In this embodiment, the controller 51 uses, as the reference setting, the setting of the AC voltage value of the charging voltage acquired in S3, and acquires 6 standards, including this reference setting, of the setting of the AC voltage value of the charging voltage. Table 1 shows an example of the 6 standards of the AC voltage value setting of the charging voltage in a normal temperature environment (desired discharge current amount of 60 μA).

TABLE 1

| Setting | Discharge current (μA) | Charging AC (kVpp) |
|---|---|---|
| −4 | 20 | 1.4 |
| −3 | 30 | 1.45 |
| −2 | 40 | 1.5 |
| −1 | 50 | 1.55 |
| 0 | 60 | 1.6 |
| 1 | 70 | 1.65 |

In this embodiment, the adjusting image is formed in each of the reference setting, 4 standard settings smaller in discharge current amount (i.e., the control target value of the alternating current value) than the reference setting, and one standard setting larger in discharge current amount than the reference setting. In this embodiment, in a normal temperature environment, a change width of a discharge current amount (i.e., the control target value of the alternating current value) per (one) standard (hereinafter, this change width is also referred to as a "change width D") is 10 μA. That is, in this embodiment, as described above, a change of the desired discharge current amount in the discharge current control is set at a large value so that the improper charging does not generate even when the adjusting control is not carried out. Accordingly, it is assumed that an adjustment result of the adjusting control is such that the discharge current amount (i.e., the control target value of the alternating current value) is smaller than that in the reference setting. For that reason, in this embodiment, as shown in Table 1, the number of the standards in which the discharge current amount is smaller than that in the reference setting is made larger than the number of the standards in which the discharge current amount is larger than that of the reference setting. However, the present invention is not limited thereto but the AC voltage value setting of the charging voltage when the adjusting images are formed may typically be only required to be changed to the reference setting and at least one setting which is larger or smaller in discharge current amount than the reference setting.

Incidentally, a column "Setting" in Table 1 represents identification marks (symbols) each showing an adjusting amount (offset amount) from that of the reference setting (hereinafter, this mark is referred to as an "offset value"). An offset value "0" represents the reference setting. An offset value "−1" represents a setting in which the change width D (10 μA in the normal temperature environment) of the discharge current amount (i.e., the control target value of the alternating current value) is made small by one level. Similarly, offset values "−2", "−3" and "−4" represent settings in which the change width D is made small by two levels, three levels and four levels, respectively. On the other hand, an offset value "+1" represents a setting in which the change width D (10 μA in this embodiment) of the discharge current amount (i.e., the control target value of the alternating current value) is made large by one level. Further, in Table 1, for convenience, the desired discharge current amount is shown in place of the AC voltage value setting of the charging voltage (the control target value of the alternating current value in this embodiment). Further, in this embodiment, an example of the AC voltage value capable of providing the desired discharge current amount is shown in combination.

Here, the change width D can be changed depending on the environment information. As a result, depending on the charging characteristic or the like, an image defect (such as image density non-uniformity) appearing on the adjusting image can be easily discriminated. In this embodiment, as shown in Table 2 below, the change width D is changed depending on the environment information detected by the environment sensor 30. That is, the change width D in the case of a second temperature higher than a first temperature is smaller than the change width D in the case of the first temperature. Information (control table) showing a relationship between the temperature and the change width D is stored in the ROM 53 in advance. However, the change width D may also be made constant irrespective of the environment.

TABLE 2

| | Temp (° C.) | | | | |
|---|---|---|---|---|---|
| | <10 | 10-20 | 20-30 | 30-40 | 40< |
| CW*1 (μA) | 15 | 12.5 | 10 | 7.5 | 5 |

*1"CW" is the change width.

Incidentally, the number of standards and the change width D of the AC voltage value setting of the charging voltage in the adjusting control can be appropriately selected so that the AC voltage value setting of the charging voltage can be adjusted with desired accuracy. Typically, the number of standards may suitably be about 3 standards or more and about 10 standards or less, and the change width D may suitably be about 3 μA or more and about 20 μA or less.

Figure 9:
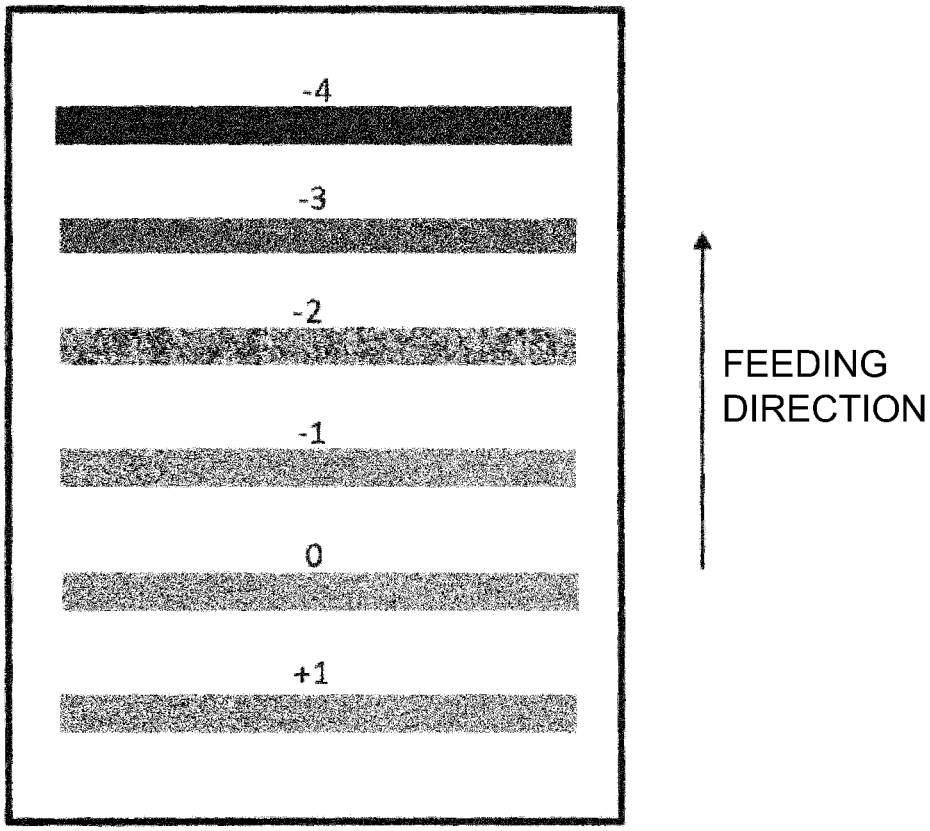
FIG. 9 is a schematic view of a chart to be outputted in the adjusting control of the charging voltage setting.

Next, the controller 51 causes the image forming portion to form the adjusting image in the AC voltage value setting of the charging voltage acquired in S4, and the adjusting image is transferred onto the transfer material P and the chart on which the adjusting image is fixed is outputted (S5). FIG. 9 is a schematic view showing an example of a chart on which adjusting images of 6 standards for one color are formed.

The adjusting images may desirably be formed in a relatively broad range with respect to the longitudinal direction of the charging roller 2 (i.e., each of the adjusting images has a length including a central portion, one end portion and the other end portion with respect to the longitudinal direction of the charging roller 2). That is, as described above, depending on characteristics and states of the photosensitive drum 1 and the charging roller 2 (the drum unit 17 in this embodiment), a local image defect generates with respect to the longitudinal direction of the photosensitive drum 1 and the charging roller 2 in some cases. For that reason, it is desirable that the image defect in a relatively broad range with respect to the longitudinal direction of the photosensitive drum 1 and the charging roller 2 can be checked. From such a viewpoint, the length of the adjusting image with respect to the direction substantially perpendicular to the feeding direction of the transfer material P may preferably be substantially equal to a length of an image formable region of the transfer material P onto which the adjusting image is to be transferred. Further, from a similar viewpoint, the transfer material P onto which the adjusting image is to be transferred may preferably be a transfer material P, of the transfer materials P on which the image can be formed in the image forming apparatus 100, having a maximum length with respect to the direction substantially perpendicular to the feeding direction. Further, the transfer material P onto which the adjusting image is to be transferred may preferably be a transfer material P, of the transfer materials P on which the image can be formed in the image forming apparatus 100, having a maximum length with respect to the feeding direction. This is because the adjusting images formed in the AC voltage value settings of the charging voltage with more standards can be formed with respect to the feeding direction of the transfer material P, so that the adjusting control can be carried out using a smaller number of the transfer materials P.

In this embodiment, for the output of the chart, of the transfer materials P on which the image can be formed in the image forming apparatus 100, a transfer material P having a size of 330 mm×483 mm (feeding direction) which are maximum with respect to the direction substantially perpendicular to the feeding direction and with respect to the feeding direction, respectively, is used. As a result, in this embodiment, even in the case where the adjusting control is carried out for all the colors, a single chart sheet obtained by transferring adjusting images for four colors each with 6 standards on a single transfer material P may only be required to be outputted. However, the present invention is not limited to the output of the chart using the maximum-sized transfer material P, but for example, a chart may also be outputted using a transfer material P having a size used for image formation after the adjusting control (typically, immediately after the adjusting control).

In this embodiment, the adjusting images for the respective colors are formed while changing the AC voltage value setting of the charging voltage in a direction in which the AC voltage value of the charging voltage increases. This is because in the constitution of this embodiment, in the case where the AC voltage value of the charging voltage is changed in an increasing direction, the change in voltage value can be stably performed faster than the case where the AC voltage value of the charging voltage is changed in a decreasing direction. However, the present invention is not limited thereto, but depending on a conveying property of the voltage output and a charging characteristic, a plurality of adjusting images may also be formed while successively decreasing the AC voltage value setting of the charging voltage.

In this embodiment, when the adjusting images are formed, designating images showing pieces of information designating the respective adjusting images are also formed in combination with the adjusting images. Then, as shown in FIG. 9, the chart obtained by transferring the designating images, associated with the adjusting images, respectively, onto the transfer material P is outputted. In this embodiment, as the designating images, the above-described offset values each indicating the adjusting amount (offset amount) from that of the reference setting are formed so as to be adjacent to (in the neighborhood of an upper side of the adjusting image in the example illustrated in FIG. 9).

Incidentally, a density of the adjusting image may preferably be a halftone density by the substantially identical image signal level with respect to the direction substantially perpendicular to the feeding direction of the transfer material P. That is, as regards the image defect generating in the case where the AC voltage value of the charging voltage is not appropriate, the case of the image defect in which the density becomes relatively thin and the case of the image defect in which the density becomes relatively thick exist. Specifically, the case of a stripe-shaped or dot-shaped image defect (white stripe, white dot) in which the density becomes relatively thin due to an excessive discharge amount and the case of a stripe-shaped or dot-shaped image defect (thick (dark) stripe, thick (dark) dot) in which the density becomes relatively thick due to an insufficient discharge amount exist. For that reason, for checking both the image defects, a halftone density is suitable. However, the present invention is not limited thereto, but the adjusting image may also be changed to a thicker image or a thinner image depending on the characteristic or the like of the image forming apparatus 100. In this embodiment, the setting of the DC voltage value of the charging voltage, a frequency of the AC voltage value of the charging voltage, the setting of the exposure amount of the exposure device 3 and the setting of the developing voltage when the adjusting images are formed are made constant. At least a part of these settings may also be changed depending on the environment information or the like.

Figure 10:
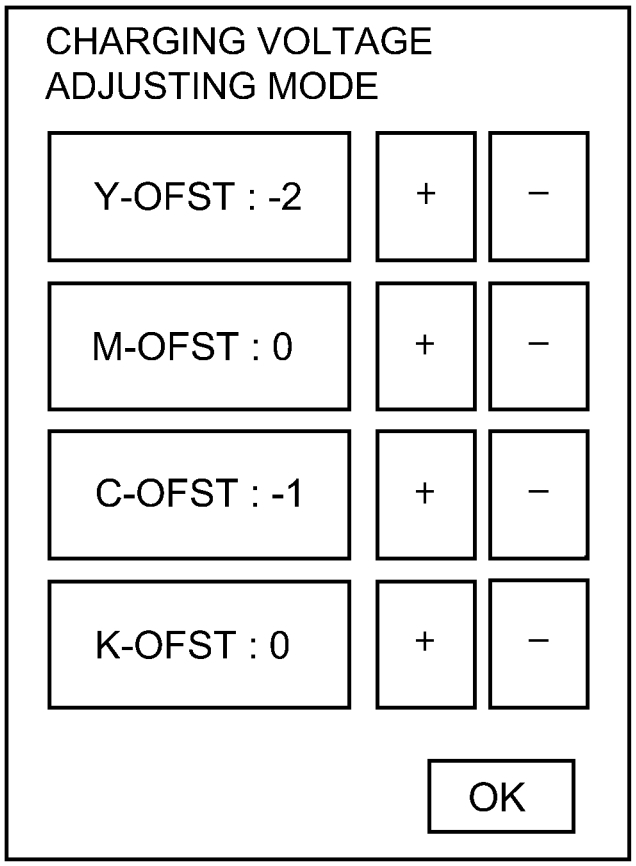
FIG. 10 is a schematic view of an interface for inputting an adjusting value of the charging voltage setting.

Then, the controller 51 causes the display of the operating portion 80 to display an interface for designating at least one adjusting image on the chart, and receives information designating the adjusting image inputted by the operator (S6). The operator checks the adjusting images on the outputted chart and discriminates that which adjusting image is most satisfactorily formed for each of the colors. In this embodiment, as described above, adjacently to the respective adjusting images, the offset values corresponding to the AC voltage value settings of the charging voltage when the adjusting images are formed, respectively. Accordingly, the operator inputs the offset value, corresponding to the adjusting image discriminated as being most satisfactorily formed, through the interface displayed on the display of the operating portion 80. FIG. 10 shows an example of an interface for designating the adjusting images in the case where the adjusting control for all the colors is carried out. In the example shown in FIG. 10, the offset value to be displayed is changed by pressing down a "+" or "−" button, so that the offset value for each of the colors can be selected. Then, by pressing down an "OK" button, information designating the adjusting images for the respective colors can be inputted to the controller 51. Incidentally, the information designating the adjusting images is not limited to the input thereof through the operating portion 80, but may also be inputted through a printer driver or the like installed in the external device such as the PC communicatably connected with the image forming apparatus 100.

Next, the controller 51 causes the back-up RAM 54 to store the information indicating the adjusting amount (offset amount), from that of the reference setting, corresponding to the adjusting image designated in S6 (S7). Then, until the information is renewed by subsequent adjusting control, the controller 51 uses the information when the photosensitive drum 1 is charged. In this embodiment, the offset values selected for the respective colors are stored in the back-up RAM 54. Further, as described above, the change width D for each temperature is stored in the ROM 53. Then, the controller 51 adjusts the AC voltage value setting, (the control target value of the AC voltage value in this embodiment) of the charging voltage determined in the latest discharge current control when the photosensitive drum 1 is charged, by (offset value)×(change width D) which are acquired by the latest adjusting control.

As described above, according to this embodiment, it becomes possible to set a proper charging voltage for each of the photosensitive drum 1, the charging roller, and a combination thereof, in which the respective members are different in characteristic and state. That is, in this embodiment, the adjusting control in which the chart on which the adjusting images formed by finely changing the AC voltage value of the charging voltage are transferred is outputted is carried out. As a result, depending on the characteristic (difference among individuals, lot difference) and the state (use hysteresis) of the photosensitive drum 1 and the charging roller 2 (drum unit 17 in this embodiment), the proper charging voltage such that the discharge amount is a necessary minimum amount can be set with accuracy. Thus, according to this embodiment, for individual drum unit 17, a necessary minimum AC voltage value of the charging voltage can be set with accuracy. As a result, not only a good image can be outputted, but also lifetime extension of the drum unit 17 can be realized.

Embodiment 2

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

In general, when a fog-removing potential difference Vback which is a potential difference between a charge potential (dark-portion potential) of the photosensitive drum 1 and a DC component of the voltage applied to the developing sleeve 41 is decreased, image density non-uniformity when the charging characteristic or the developing characteristic is non-uniform becomes conspicuous. In this embodiment, by using this characteristic, a difference between the DC voltage value of the charging voltage and the DC voltage value of the developing voltage when the adjusting images are formed is made smaller than the difference during normal image formation, so that the image defect appearing on the adjusting images is made easily discriminate. As a result, the image density non-uniformity which potentially exists but does not readily appear as a phenomenon is checked, so that a proper AC voltage value of the charging voltage is easily set.

In this embodiment, as an example, the fog-removing potential difference Vback during the normal image formation is set at 175 V. On the other hand, the fog-removing potential difference Vback when the adjusting images are formed is set at 100 V. In this embodiment, particularly, the DC voltage value of the charging voltage when the adjusting images are formed is made different from that during the normal image formation, so that the fog-removing potential difference Vback when the adjusting images are formed is made different from that during the normal image formation. Specifically, in this embodiment, during the normal image formation, the DC voltage value of the charging voltage is −700 V, and the DC voltage value of the developing voltage is −500 V. On the other hand, when the adjusting images are formed, the DC voltage value of the charging voltage is changed to −625 V. In this embodiment, the surface potential of the photosensitive drum 1 is attenuated until the photosensitive drum surface is charged by the charging roller 2 and reaches the developing position (opposing portion between the developing sleeve 41 and the photosensitive drum 1 in this embodiment), so that an about value thereof decreases. For that reason, by the above-described setting, the fog-removing potential difference Vback at the developing position is 175 V during the normal image formation and is 100 V when the adjusting images are formed.

In this embodiment, the DC voltage value of the charging voltage when the adjusting images are formed is made different from that during the normal image formation, but when the adjusting images are formed, the DC voltage value of the developing voltage or both of the DC voltage value of the charging voltage and the DC voltage value of the developing voltage may also be made different from those during the normal image formation.

As described above, according to the present invention, the image defect appearing on the adjusting image is easily checked, so that it becomes possible to set a proper AC voltage value of the charging voltage with accuracy.

Embodiment 3

Next, another embodiment of the present invention will be described. Basic constitutions and operations of an image forming apparatus in this embodiment are the same as those of the image forming apparatus in Embodiment 1. Accordingly, in the image forming apparatus in this embodiment, elements having the same or corresponding functions and constitutions as those in the image forming apparatus in Embodiment 1 are represented by the same reference numerals or symbols as those in Embodiment 1 and will be omitted from detailed description.

When the presence or absence of the image defect is intended to be discriminated with accuracy in the adjusting control, it is desirable that the presence or absence of generation of a slight dot-shaped image density non-uniformity (dot) which is called a sandpaper-like image or generation of a stripe-shaped image density non-uniformity (latent stripe) extending in the direction substantially perpendicular to the feeding direction of the transfer material P is discriminated. However, as regards the color such as yellow high in brightness, the generation of the slight image density non-uniformity as described above is not readily recognized.

Therefore, in this embodiment, in the adjusting control for yellow difficult in discrimination of the slight image density non-uniformity as described above, the adjusting images are formed with the toners of the plurality of colors (secondary color in this embodiment) including yellow. The adjusting images (images for adjusting a multiple-order color) formed with the plurality of color toners are superposed on the intermediary transfer belt 7 and are transferred onto the transfer material P, and then are color-mixed with each other when the adjusting images are fixed in the transfer material P by the fixing device 13. That is, in this embodiment, depending on whether or not it is difficult to discriminate the image defect for a single color, a manner of forming the adjusting images is made different between the adjusting image formation with the single color and the adjusting image formation with the secondary color including the single color.

Here, also in the case where the adjusting images are formed with the toners of the plurality of colors, the AC voltage value setting of the charging voltage is changed only in formation of a single color toner image to be adjusted, and in formation of the other color toner image, the AC voltage value setting of the charging voltage is the reference setting.

Table 3 below shows a relationship among the color to be adjusted, the color of the toner with which the adjusting images are formed, and the color for changing the AC voltage value setting of the charging voltage. In this embodiment, in the adjusting control for yellow, the adjusting images are formed with yellow toner and magenta toner, and the AC voltage value setting of the charging voltage is changed only in the formation of the toner image of yellow.

TABLE 3

| CTBA*1 | IC*2 | CFCCAC*3 |
|---|---|---|
| Y | Y, M | Y |
| M | M | M |
| C | C | C |
| K | K | K |

*1"CTBA" is the color to be adjusted.
*2"AIC" is the adjusting image color.
*3"CFCCAC" is the color for changing the charging AC (voltage).

In this embodiment, only in the adjusting control for yellow, the adjusting images are formed with the plurality of color toners, but each of pieces of the adjusting control for the plurality of colors, the adjusting images may also be formed with a plurality of color toners. Further, the color of the adjusting images formed with the plurality of color toners is the secondary color, but is not limited thereto, and may also be a tertiary color, for example.

As described above, according to this embodiment, also as regards the color difficult in discrimination of the presence or absence of the image defect for the single color, it becomes possible to set a proper AC voltage value of the charging voltage with high accuracy.

Other Embodiments

The present invention was described based on the specific embodiments mentioned above, but is not limited to the above-mentioned embodiments.

In the above-described embodiments, a predetermined discharge current amount in the discharge current control was changed depending on the temperature, so that the reference setting of the AC voltage value of the charging voltage in the adjusting control was changed. On the other hand, depending on the characteristics of the photosensitive drum and the charging roller, the charging characteristic is correlated with a humidity (relative humidity, absolute water content) in some cases. Accordingly, by changing the predetermined discharge current amount in the discharge current control depending on the humidity, the reference setting in the adjusting control can be changed. In this case, typically, a desired discharge current amount (i.e., the reference setting of the AC voltage value of the charging voltage) in the case where the humidity is a second humidity higher than a first humidity is made smaller than a desired discharge current amount in the case where the humidity is the first humidity. Similarly, also the change width D in the adjusting control can be changed depending on the humidity. In this case, the change width D in the case where the humidity is the second humidity higher than the first humidity is made smaller than the change width D in the case where the humidity is the first humidity. Incidentally, the above-described desired discharge current amount and desired change width P may also be changed depending on both of the temperature and the humidity. Further, the adjusting control is not limited to that in which a result of the discharge current control is used as the reference setting, but may also be independently carried out using a predetermined reference setting. Also in this case, the reference setting can be changed depending on at least one of the temperature and the humidity.

Further, in the above-described embodiments, the discharge current control was carried out when the adjusting control was carried out, with the result that the reference setting in the adjusting control was changed depending on a use amount of at least one of the photosensitive drum and the charging roller. However, as described above, the adjusting control may also be independently carried out using the predetermined reference setting. Also in this case, the reference setting of the AC voltage value of the charging voltage can be changed depending on an index value (a counting result of a counter (counting means)) correlated with the use amount of at least one of the photosensitive drum and the charging roller. As the index value correlated with the use amount of the photosensitive drum and the charging roller, arbitrary values such as a number of times of rotation, a rotation time, a time or number of times of rotation in which the charging process is performed, a print number, and the like can be used. In this case, for example, in a system in which a lowering in electric resistance of the photosensitive layer with an increase in use amount of the photosensitive drum is relatively large, the region setting in the case where the index value correlated with the use amount is a second value larger than a first value and be made smaller than the reference setting in the case where the index value is the first value. Further, for example, in a system in which an increase in electric resistance of the charging roller with an increase in use amount of the charging roller is relatively large, the reference setting in the case where the index value correlated with the use amount is the second value larger than the first value can be made larger than the different setting in the case where the index value is the first value. Similarly, also the change width D in the adjusting control can be changed depending on the index value correlated with the use amount of at least one of the photosensitive drum and the charging roller.

Further, in the above-described embodiments, the photosensitive drum and the charging roller are integrally assembled into the drum unit which is detachably mountable to the apparatus main assembly, but at least one of the photosensitive drum and the charging roller may also be independently detachably mountable to the apparatus main assembly.

Further, in the above-described embodiments, the case where the adjusting control was carried out in accordance with the instruction provided from the operator through the operating portion was described, but may also be automatically carried out in the case where at least one of the photosensitive drum and the charging roller is exchanged or in the like case. In this case, it is possible to use a mounting and demounting detecting means for detecting mounting and demounting of the photosensitive drum, the charging roller or a combination (drum unit) thereof with respect to the apparatus main assembly and to use a new article detecting means for detecting that these means are new articles. As the mounting and demounting detecting means, for example, an arbitrary switch or the like, such as a photo-interrupter or a micro-switch, in which an ON/OFF state thereof is changed depending on the mounting and demounting of an object to be detected can be provided in the apparatus main assembly. Further, as the new article detecting means, for example, a storing portion for storing information indicating that the photosensitive drum, the charging roller, or the combination (drum unit) thereof are new articles (or are not new articles) can be provided on these articles. Further, on the basis of a detection result of the mounting and demounting detecting means or the new article detecting means, the controller is capable of executing the adjusting control after the mounting and the demounting of the photosensitive drum, the charging roller or the combination thereof or the exchange of these articles with new articles is performed and before a first image is formed.

In the above-described embodiments, the case where the charging member was contacted to the surface of the photosensitive drum which was a member-to-be-charged was described as an example, but the charging member is not necessarily required to be contacted to the surface of the photosensitive drum. When a dischargeable region based on Paschen's law is provided between the charging member and the photosensitive drum, these members may also be disposed in non-contact with each other with a spacing (gap) of several 10 μm, for example.

Further, the charging member is not limited to the roller-shaped member, but may also be a member, which is stretched by a plurality of stretching rollers and which is formed in an endless belt shape or in a blade shape. The image bearing member is not limited to the drum-shaped photosensitive member (photosensitive drum), but may also be an endless belt-shaped photosensitive member (photosensitive member belt). When the image forming apparatus is of an electrostatic recording type, the image bearing member is an electrostatic recording dielectric member formed in a drum shape or in an endless belt shape.

Further, in the above-described embodiments, the image forming apparatus was the image forming apparatus of an intermediary transfer type including the intermediary transfer member, but the present invention is also applicable to an image forming apparatus of a direct transfer type including a transfer material carrying member. In the image forming apparatus of the direct transfer type, the toner images formed on the image bearing members of the respective image forming portions are directly transferred onto the transfer material carried and fed by the transfer material carrying member constituted by an endless belt or the like. Further, the present invention is not limited to the color image forming apparatus, but may also be applicable to a monochromatic image forming apparatus for a single color such as black. In the monochromatic image forming apparatus, in general, a toner image formed on an image bearing member is directly transferred onto a transfer material by a transfer member provided opposed to the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-077781 filed on Apr. 10, 2017, which is hereby incorporated by reference herein in its entirety.

What is claimed is:

1. An image forming apparatus comprising:

a rotatable photosensitive member;

a charging roller configured to electrically charge said photosensitive member by applying a charging voltage in a form of a DC voltage biased with an AC voltage;

an exposure device configured to expose said photosensitive member charged by said charging roller to light to form an electrostatic latent image;

a developing device configured to develop the electrostatic latent image into a toner image by depositing toner on the electrostatic latent image formed on said photosensitive member;

a transfer member configured to transfer the toner image onto a recording material;

a fixing device configured to fix the transferred toner image on the recording material;

a voltage source configured to output the charging voltage applied to said charging roller;

an executing portion configured to form a test chart including a plurality of adjusting images on the recording material, the plurality of adjusting images being formed by said photosensitive member charged by applying charging voltages in the form of a predetermined DC voltage biased with AC voltages of different peak-to-peak voltage values, respectively;

a first inputting portion through which an instruction of execution of forming the test chart is inputted; and a second inputting portion through which an instruction of setting a value of the peak-to-peak voltage values of the AC voltage during image formation is inputted.

2. An image forming apparatus according to claim 1, comprising a plurality of image forming stations each including said photosensitive member, said charging roller, said exposure device and said developing device, wherein said executing portion is configured to form the test chart so that the adjusting images correspond to said image forming stations, respectively.

3. An image forming apparatus according to claim 2, wherein said developing devices corresponding to said image forming stations, respectively, use toners different in color.

4. An image forming apparatus according to claim 3, wherein the adjusting images include a plurality of multi-order color adjusting images obtained by superposing an image of yellow toner of the toners different in color with a respective toner of the toners of colors different from yellow.

5. An image forming apparatus according to claim 4, wherein when the multi-order color adjusting images are formed, said executing portion is configured to control the charging voltage so that the peak-to-peak voltage corresponding to said image forming station using the yellow toner is set so as to be successively changed to a plurality of different values and so that the peak-to-peak voltage corresponding to said image forming station using the toner of the color different from yellow is set at a predetermined value common to that of the multi-order color adjusting images.

6. An image forming apparatus according to claim 1, wherein said executing portion changes the peak-to-peak voltages of the AC voltages corresponding to the adjusting images, respectively, in an ascending order.

7. An image forming apparatus according to claim 1, wherein said executing portion is configured to form the test chart so that with respect to a direction substantially perpendicular to a recording material feeding direction, a length of a region including the adjusting images of the test chart is substantially equal to a length of a maximum image forming region.

8. An image forming apparatus according to claim 1, wherein said executing portion is configured to form the test chart so that all of the adjusting images are formed on a single recording material.

9. An image forming apparatus according to claim 1, wherein said executing portion displays information associated with each of the adjusting images at a position corresponding to each of the adjusting images.

10. An image forming apparatus according to claim 9, wherein said first inputting portion is constituted so that an operator is capable of inputting the information corresponding to at least one adjusting image selected from the adjusting images included in the test chart to be outputted.

11. An image forming apparatus according to claim 10, wherein said executing portion is configured to set the peak-to-peak voltage of the charging voltage applied to said charging roller in an image forming period at the peak-to-peak voltage corresponding to the information inputted through said second inputting portion.

12. An image forming apparatus according to claim 1, wherein for the test chart, of recording materials on which an image can be formed by said image forming apparatus, the recording material having a maximum length with respect to a direction substantially perpendicular to a recording material feeding direction is used.

13. An image forming apparatus according to claim 1, wherein for the test chart, of recording materials on which an image can be formed by said image forming apparatus, the recording material having a maximum length with respect to a recording material feeding direction is used.

14. An image forming apparatus according to claim 1, further comprising a setting portion configured to set the peak-to-peak voltage value, providing a predetermined target discharge current value, in a period other than an image forming period, on the basis of a detection result of values of alternating currents flowing through said charging roller when said photosensitive member is charged by applying, to said charging roller, the charging voltages successively changed to the different peak-to-peak voltage values while maintaining the predetermined DC voltage, wherein said executing portion is configured to form the test chart so that the peak-to-peak voltage value when at least one of the adjusting images is formed is set at the peak-to-peak voltage value providing the predetermined target discharge current value set by said setting portion.

15. An image forming apparatus according to claim 1, further comprising an environment sensor configured to detect at least one of a temperature and a humidity at an inside or an outside of said image forming apparatus, wherein said executing portion is configured to control on the basis of a detection result of said environment sensor so as to change the peak-to-peak voltage value when the adjusting images are formed.

16. An image forming apparatus according to claim 1, wherein said executing portion is configured to control on the basis of an amount of use of at least one of said photosensitive member and said charging roller so as to change the peak-to-peak voltage value when the adjusting images are formed.

17. An image forming apparatus according to claim 1, wherein the plurality of adjustment images extend in a direction perpendicular to a feeding direction of the recording material.

* * * * *